US008042581B2

(12) United States Patent
Green et al.

(10) Patent No.: US 8,042,581 B2
(45) Date of Patent: Oct. 25, 2011

(54) VALVE ASSEMBLY FOR POWDER DISPENSER

(76) Inventors: Scott David Green, Birmingham, AL (US); Joseph Michael Wyatt, Pinson, AL (US)

( * ) Notice: Subject to any disclaimer, the term of this patent is extended or adjusted under 35 U.S.C. 154(b) by 1042 days.

(21) Appl. No.: 11/851,511

(22) Filed: Sep. 7, 2007

(65) Prior Publication Data

US 2009/0065092 A1 Mar. 12, 2009

(51) Int. Cl.
*B65B 3/00* (2006.01)

(52) U.S. Cl. ..... 141/360; 141/18

(58) Field of Classification Search ..... 141/18, 141/311 R, 351, 360, 362
See application file for complete search history.

(56) References Cited

U.S. PATENT DOCUMENTS

| | | | | |
|---|---|---|---|---|
| 2,128,488 | A | 8/1938 | Koerner | |
| 2,849,035 | A * | 8/1958 | Ole | 141/360 |
| 3,250,303 | A * | 5/1966 | Sollmann | 141/372 |
| 3,254,802 | A | 6/1966 | Barnes | |
| 3,822,032 | A | 7/1974 | Vergobbi | |
| 3,923,085 | A | 12/1975 | Nimer | |
| 5,480,063 | A | 1/1996 | Keyes | |
| 5,542,412 | A | 8/1996 | Century | |
| 5,725,131 | A | 3/1998 | Bell | |
| 6,047,746 | A | 4/2000 | Green | |
| 6,189,742 | B1 | 2/2001 | Thomson et al. | |
| 6,253,959 | B1 | 7/2001 | Gaultney | |
| 6,315,170 | B1 | 11/2001 | Thomson et al. | |
| 6,371,331 | B1 | 4/2002 | Gohde | |
| 6,619,510 | B2 | 9/2003 | Green | |
| 2007/0113924 | A1 | 5/2007 | Phillips, Jr. | |
| 2008/0302440 | A1 * | 12/2008 | Crossdale et al. | 141/18 |

* cited by examiner

*Primary Examiner* — Gregory Huson
*Assistant Examiner* — Jason Niesz
(74) *Attorney, Agent, or Firm* — Kenneth M. Bush; Bush Intellectual Property Law

(57) ABSTRACT

A powder dispenser comprising a powder container having an opening in a lower end thereof, a powder receptacle having a flange, and a flow control assembly having pivotable flow control arms biased against each other, pivotable activation arms biased towards each other, and connecting members for connecting the flow control arms to the activation arms for concomitant movement, wherein the receptacle flange is operable to engage the activation arms to pivot the activation arms away from each other and thereby pivot the flow control arms away from each other so that powder is allowed to flow through the flow control assembly into the receptacle. The dispenser may further comprise an agitator that is operable to agitate the powder in the container when the flow control arms are pivoting towards or away from each other.

8 Claims, 7 Drawing Sheets

VALVE ASSEMBLY FOR POWDER DISPENSER

FIELD OF THE INVENTION

The present invention is directed to powder dispensing devices, and more particularly, to a valve assembly for use in an apparatus for dispensing a flowable, granulated powder.

BACKGROUND OF THE INVENTION

Devices are known for filling receptacles with granular, particulate, and/or powdered materials that are transported from a storage container into a receptacle. Dispensing mechanisms for these devices range from open containers with scoops to coin operated machines. Granular matter, such as sand, can be provided in various colors and can be dispensed from storage containers to produce a decorative art form in a transparent receptacle. Likewise, granular food products, such as powdered candy, can also be dispensed to produce a decorative art form in a receptacle with the added attraction of being edible. However, granular or powdered food products need special care to avoid contamination. Thus, there is a need for a dispensing system for granular food materials that will avoid contamination between the dispensing mechanism and the receptacles that receive the granular food material.

SUMMARY OF THE INVENTION

The present invention is a powder dispenser comprising a powder container having an opening in a lower end thereof, a powder receptacle having a flange, and a flow control assembly having upper pivotable flow control arms biased against each other, lower pivotable activation arms biased towards each other, and connecting members for connecting the flow control arms to the activation arms for concomitant movement, wherein the receptacle flange is operable to engage the activation arms to pivot the activation arms away from each other and thereby pivot the flow control arms away from each other so that powder is allowed to flow through the flow control assembly into the receptacle. The dispenser may further comprise an agitator connected to one of the flow control arms and extending into the container opening, wherein the agitator is operable to agitate the powder when the flow control arms are pivoting towards or away from each other.

These and other features of the invention will become apparent from the following detailed description of the preferred embodiment of the invention.

DETAILED DESCRIPTION OF THE PREFERRED EMBODIMENT

Figure 1:
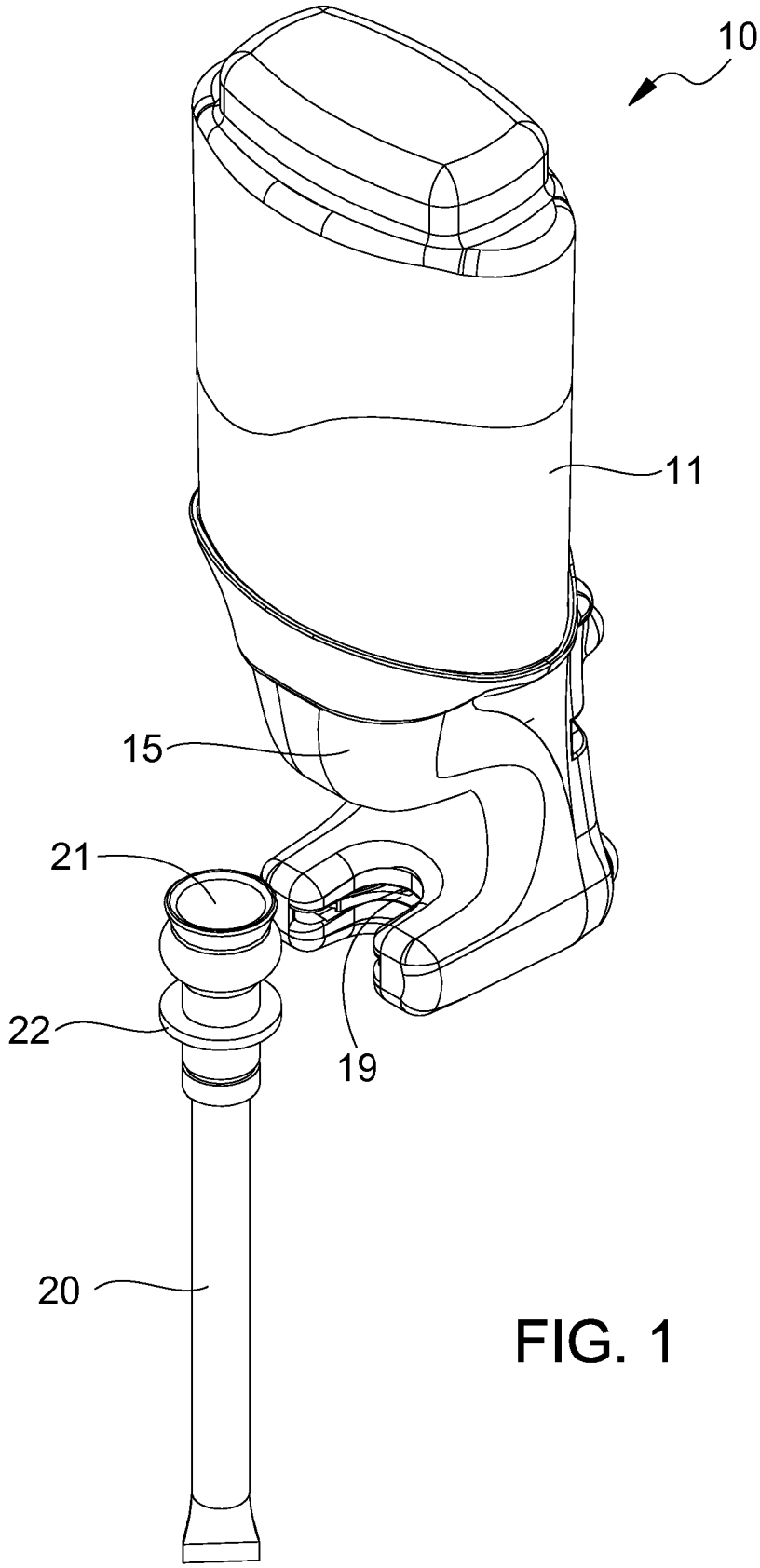
FIG. 1 is a perspective view of the present invention.
Figure 2:
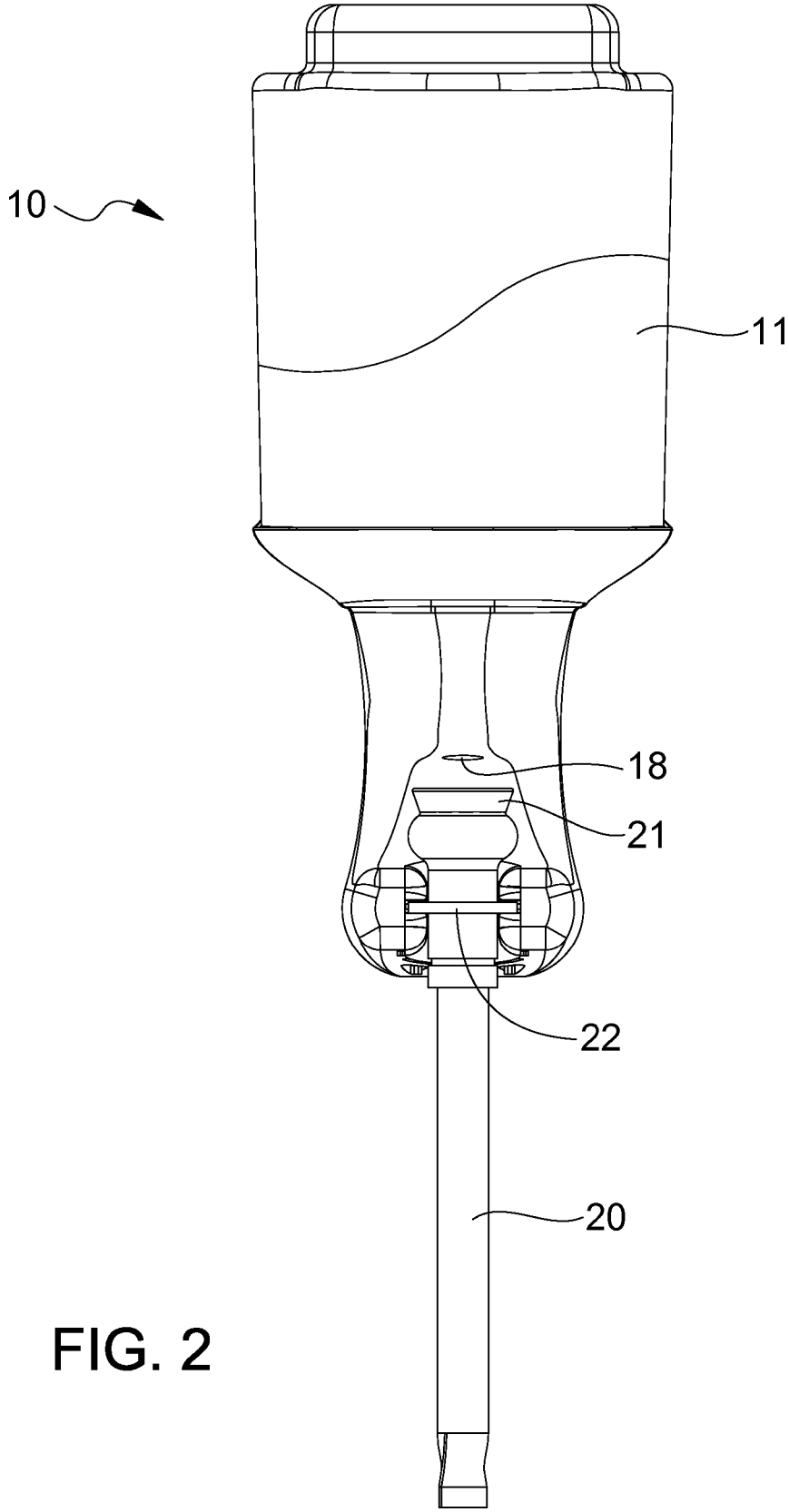
FIG. 2 is a front elevational view of the present invention.
Figure 3:
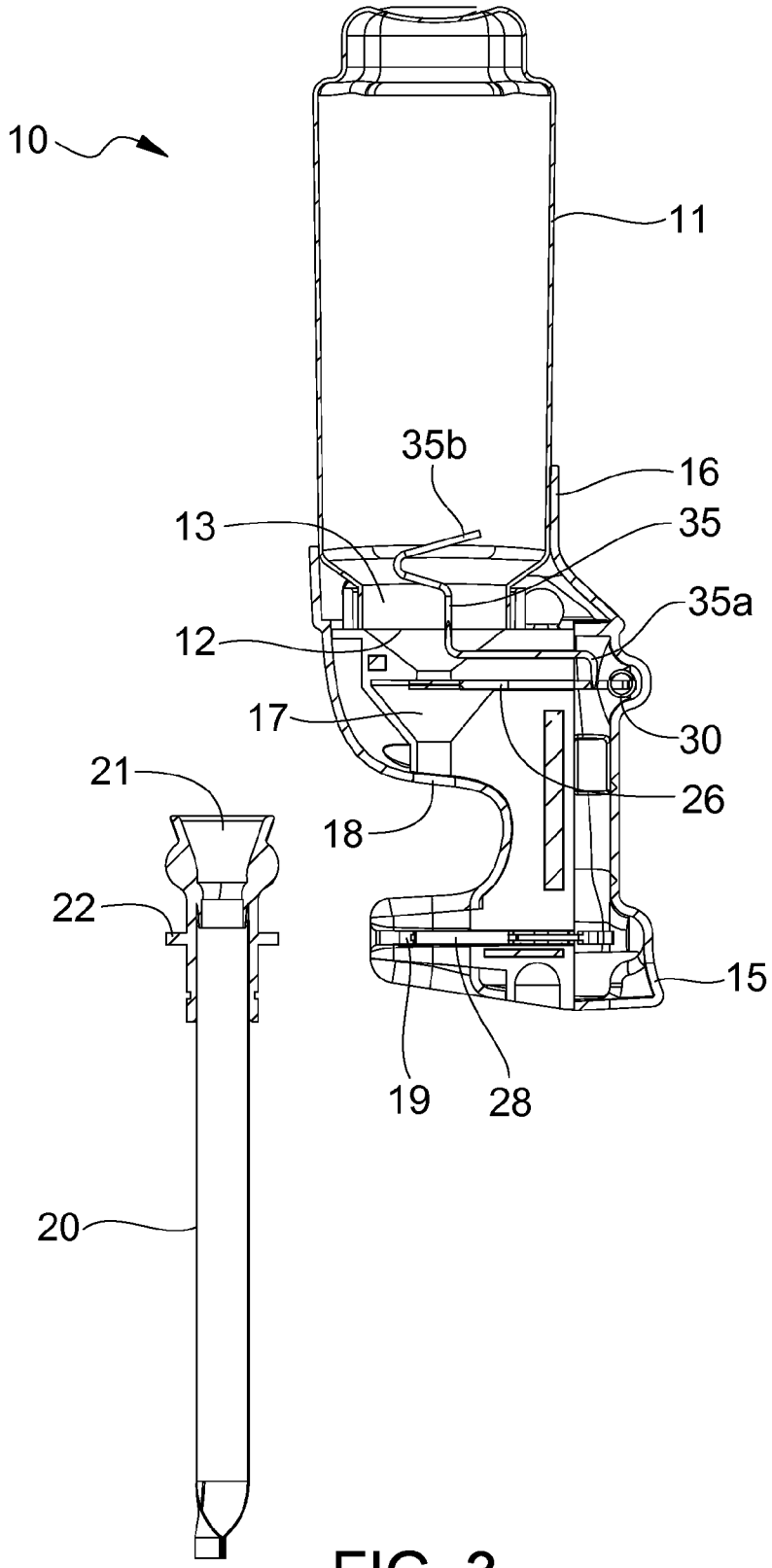
FIG. 3 is a side sectional view of the present invention.
Figure 4:
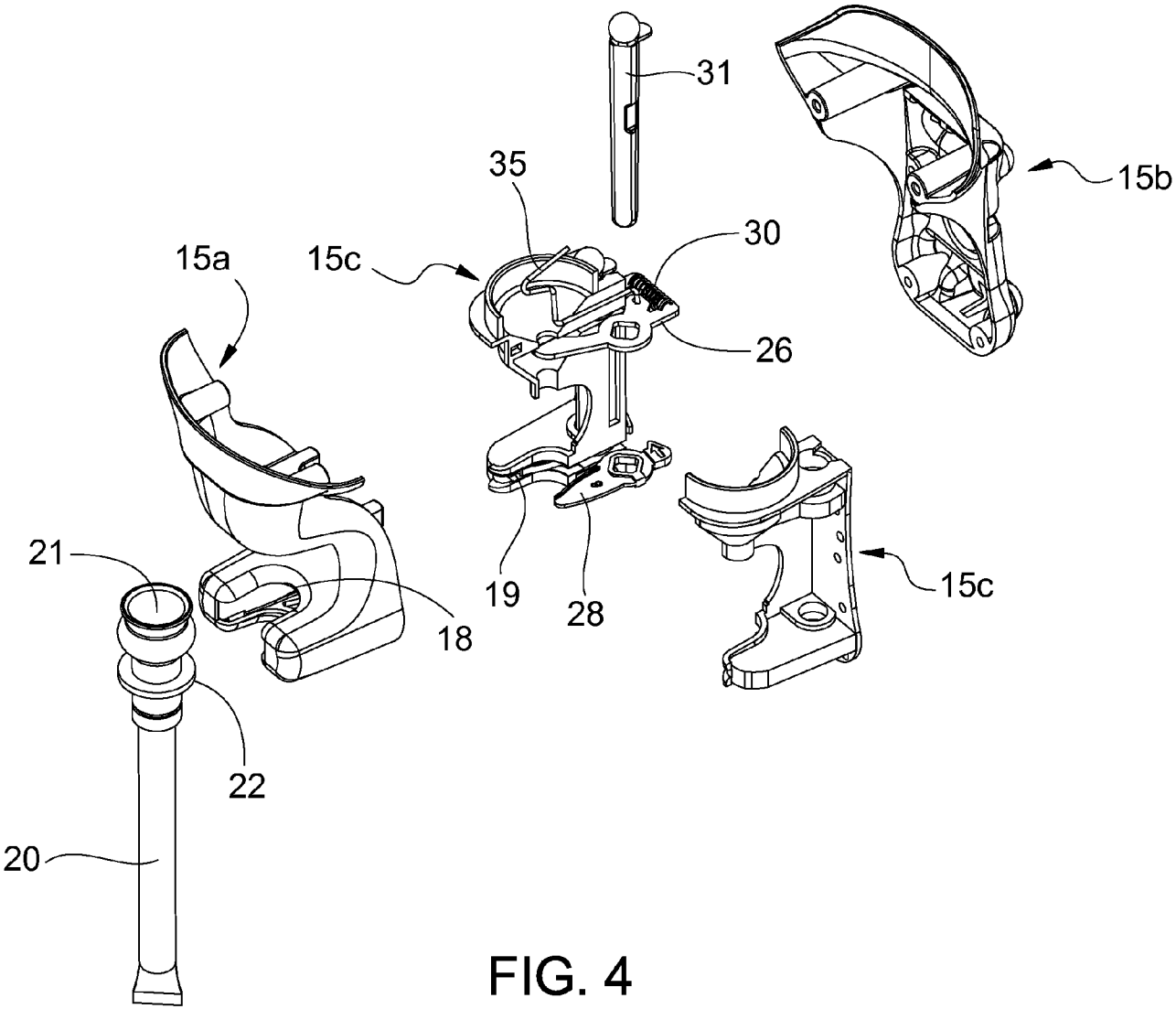
FIG. 4 is an exploded perspective view of the present invention.
Figure 5:
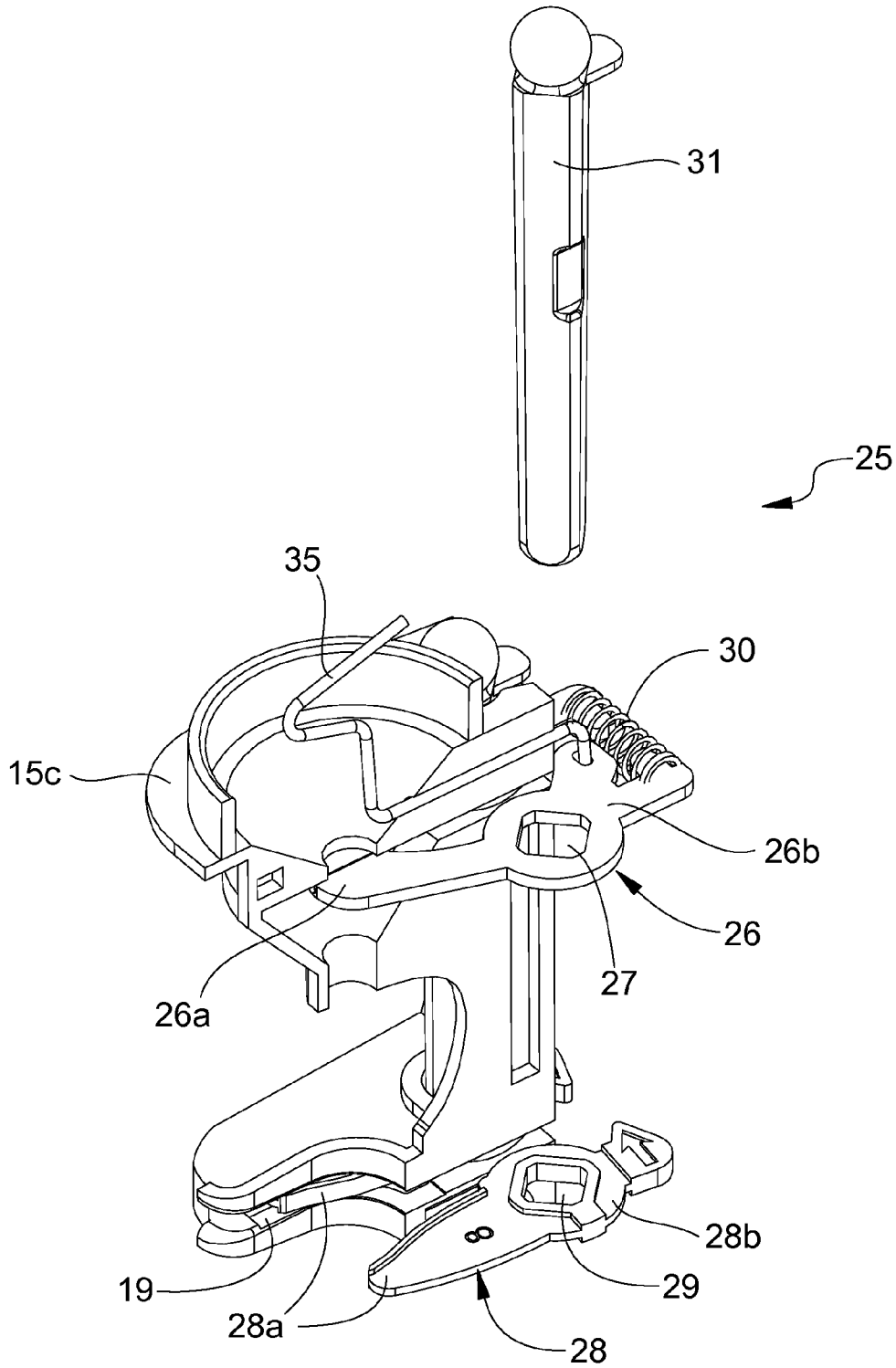
FIG. 5 is an enlarged view of the valve assembly from FIG. 4.
Figure 6:
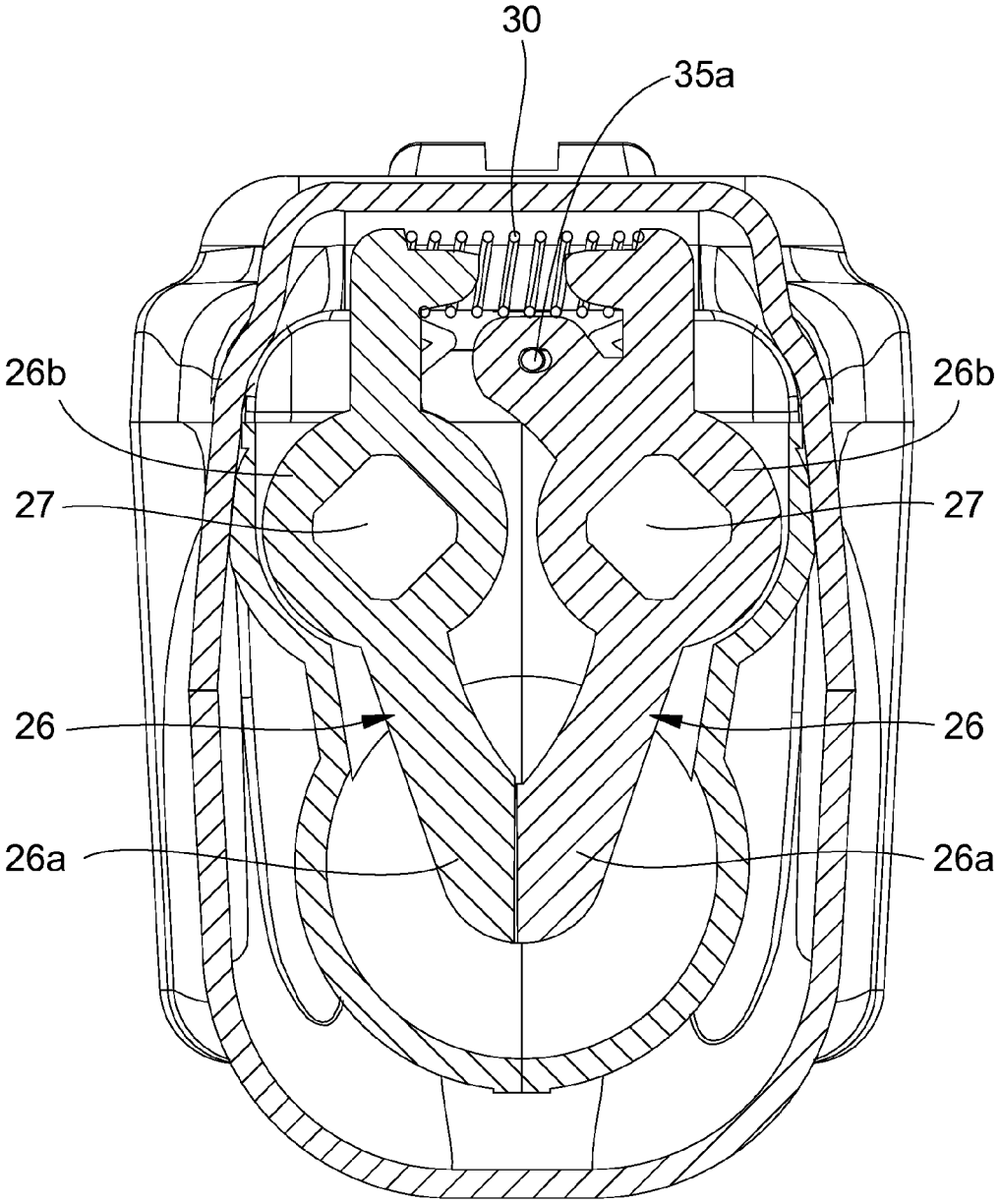
FIG. 6 is a top sectional view of the flow control mechanism of the valve assembly.
Figure 7:
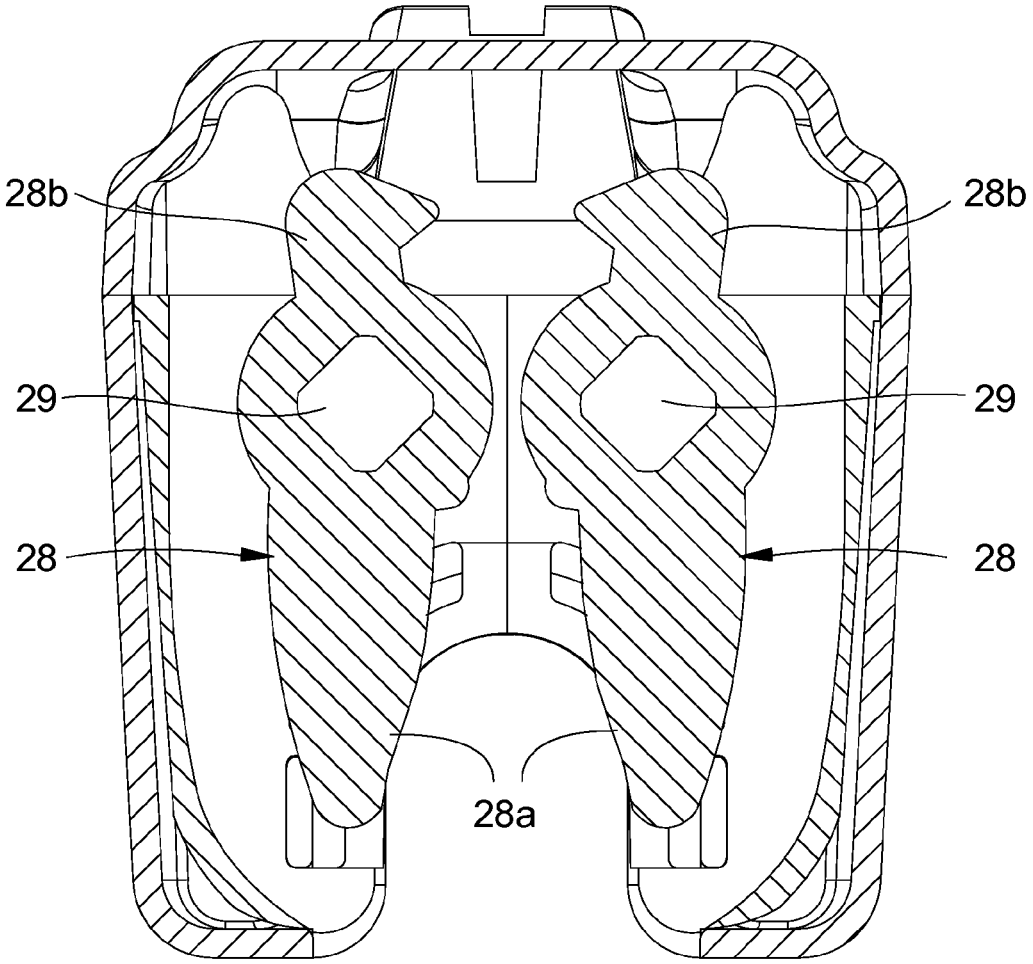
FIG. 7 is a top sectional view of the activation mechanism of the valve assembly.

The present invention, shown in FIGS. 1-7, is a powder dispensing apparatus 10 comprising a replaceable container

11 for holding a powdered material, such as sand or powdered candy. The container 11 has an opening 12 in a lower end 13 thereof through which the powder flows from the container 11. The apparatus 10 further comprises a housing 15 for a valve assembly 25, wherein the housing 15 comprises a front member 15*a*, a rear member 15*b*, and two side members 15*c*. The housing 15 further comprises an open upper end 16 for receiving the lower end 13 of the container 11, a channel 17 for the powder to flow through, an opening 18 for the powder to flow out of the housing 15, and an arcuate slot 19. The apparatus 10 further comprises a receptacle 20 having an open upper end 21 for receiving the powder and an annular flange 22 for insertion into the slot 19 to activate the valve assembly 25 to allow the powder to flow from the container 11 to the receptacle 20.

The valve assembly 25 comprises first and second pivotable flow control arms 26, each having a first end 26*a* and a second end 26*b* having a hole 27 therethrough. The first ends 26*a* of the flow control arms 26 are biased against each other by a spring 30, thereby preventing powder from flowing out of the container 11. The valve assembly 25 further comprises first and second pivotable activation arms 28, each having a first end 28*a* and a second end 28*b* having a hole 29 therethrough. The first ends 28*a* of the pivotable activation arms 28 are biased towards each other as a result of the action of spring 30. The valve assembly 25 further comprises first and second connecting members 29 for connecting the flow control arms 26 to the activation arms 28 for concomitant movement. Each connecting member 29 is connected to a flow control arm 26 and an activation arm 28 via holes 27 and 29.

The apparatus 10 preferably further comprises an agitator arm 35 having a first end 35*a* connected to one of the flow control arms 26 and a second end 35*b* extending into the container 11 through the opening 12, wherein the agitator arm 35 is operable to agitate the powder to enhance flow when the flow control arms 26 are pivoting towards or away from each other.

In operation, the flange 22 of the receptacle 20 is inserted into the slot 19 of the housing 15 until the activation arms 28 are engaged. As the receptacle 20 is pushed further into the slot 19, the open end 21 of the receptacle 20 is aligned under the flow opening 18 of the housing 15 and the flange 22 acts as a cam to push the activation arms 28 apart. As the activation arms 28 pivot apart, the connecting members 29 pivot the flow control arms 26 apart, thereby allowing powder to flow from the container 11, through the valve assembly 25, and out through the flow opening 18 into the receptacle 20. When the receptacle 20 is removed, the spring 30 biases the flow control arms 26 back into engagement so that the powder flow is terminated. As the flow control arms 26 pivot between open and closed positions, the agitator arm 35 is activated to agitate the powder to enhance flow and prevent clumping of the powder.

While the invention has been shown and described in some detail with reference to a specific exemplary embodiment, there is no intention that the invention be limited to such detail. On the contrary, the invention is intended to include any alternative or equivalent embodiments that fall within the spirit and scope of the invention as described above and as recited in the appended claims.

The invention claimed is:

1. A powder dispensing apparatus, comprising:

a. a container for holding the powder, said container having an opening in a lower end thereof;

b. a receptacle for receiving the powder, said receptacle having a flange;

c. a valve assembly comprising a pair of opposing pivotable flow control arms biased towards each other, a pair of opposing pivotable activation arms biased towards each other, and means for connecting said flow control arms to said activation arms for concomitant movement; and d. a housing for said valve assembly, wherein said housing comprises an upper opening for receiving said lower end of said container and a slot for receiving said flange of said receptacle, wherein said activation arms of said valve assembly extend into said slot;

e. wherein said flange is operable to engage said activation arms to pivot said activation arms away from each other and thereby pivot said flow control arms away from each other so that the powder is allowed to flow though said valve assembly into said receptacle when said flange is inserted into said slot.

2. An apparatus according to claim 1, further comprising an agitator arm having a first end connected to said valve assembly and a second end extending into said container through said opening in said lower end thereof, wherein said agitator arm is operable to agitate the powder when said flow control arms are pivoting towards or away from each other.

3. A powder dispensing apparatus, comprising:

a. a container for holding the powder, said container having an opening in a lower end thereof;

b. a receptacle for receiving the powder, said receptacle having an annular flange;

c. a valve assembly comprising first and second pivotable flow control arms biased towards each other, first and second pivotable activation arms biased towards each other, a first connecting member for connecting said first flow control arm to said first activation arm for concomitant movement, and a second connecting member for connecting said second flow control arm to said second activation arm for concomitant movement; and d. a housing for said valve assembly, wherein said housing comprises an upper opening for receiving said lower end of said container and an arcuate slot for receiving said annular flange of said receptacle, wherein said activation arms of said valve assembly extend into said slot;

e. wherein said annular flange is operable to engage said activation arms to pivot said activation arms away from each other and thereby pivot said flow control arms away from each other so that the powder is allowed to flow though said valve assembly into said receptacle when said annular flange is inserted into said slot.

4. An apparatus according to claim 3, further comprising an agitator arm having a first end connected to said valve assembly and a second end extending into said container through said opening in said lower end thereof, wherein said agitator arm is operable to agitate the powder when said flow control arms are pivoting towards or away from each other.

5. A powder dispensing apparatus, comprising:

a. a container for holding the powder, said container having an opening in a lower end thereof;

b. a receptacle for receiving the powder, said receptacle having a flange; and c. a flow control assembly comprising an upper opening for receiving said lower end of said container, first and second pivotable flow control arms biased towards each other, first and second pivotable activation arms biased towards each other, a first connecting member for connecting said first flow control arm to said first activation arm for concomitant movement, and a second connecting member for connecting said second flow control arm to said second activation arm for concomitant movement;

d. wherein said flange is operable to engage said activation arms to pivot said activation arms away from each other and thereby pivot said flow control arms away from each other so that the powder is allowed to flow though said flow control assembly into said receptacle.

6. An apparatus according to claim 5, further comprising an agitator arm having a first end connected to one of said flow control arms and a second end extending into said container through said opening in said lower end thereof, wherein said agitator arm is operable to agitate the powder when said flow control arms are pivoting towards or away from each other.

7. A powder dispensing apparatus, comprising:

a. a container for holding the powder, said container having an opening in a lower end thereof;

b. a receptacle for receiving the powder, said receptacle having a flange; and c. a flow control assembly comprising an upper opening for receiving said lower end of said container, a pair of opposing pivotable flow control arms biased towards each other, a pair of opposing pivotable activation arms biased towards each other, and means for connecting said flow control arms to said activation arms for concomitant movement;

d. wherein said flange is operable to engage said activation arms to pivot said activation arms away from each other and thereby pivot said flow control arms away from each other so that the powder is allowed to flow though said flow control assembly into said receptacle.

8. An apparatus according to claim 7, further comprising an agitator arm having a first end connected to one of said flow control arms and a second end extending into said container through said opening in said lower end thereof, wherein said agitator arm is operable to agitate the powder when said flow control arms are pivoting towards or away from each other.

* * * * *